US005088903A

United States Patent [19]

Tomatsu

[11] Patent Number: 5,088,903

[45] Date of Patent: Feb. 18, 1992

[54] COMPRESSOR, SPRAY APPARATUS USING THE COMPRESSOR, AND AIR BRUSH FOR THE SPRAY APPARATUS

[75] Inventor: Tsutomu Tomatsu, Aichi, Japan

[73] Assignee: Pilot Ink Co., Ltd., Aichi, Japan

[21] Appl. No.: 680,047

[22] Filed: Mar. 29, 1991

Related U.S. Application Data

[63] Continuation of Ser. No. 327,051, Mar. 22, 1989, abandoned.

[30] Foreign Application Priority Data

Mar. 25, 1988 [JP] Japan ..... 63-72863

[51] Int. Cl.[5] ..... F04B 45/02

[52] U.S. Cl. ..... 417/473; 239/526

[58] Field of Search ..... 417/473; 239/526

[56] References Cited

U.S. PATENT DOCUMENTS

| | | | |
|---|---|---|---|
| 2,829,006 | 4/1958 | Johansson | 239/526 X |
| 2,999,646 | 9/1961 | Wagner | 239/526 X |
| 3,444,922 | 5/1969 | Dingman | 417/473 X |
| 3,559,891 | 2/1971 | Liedberg et al. | 239/526 X |
| 4,005,825 | 2/1971 | Schowiak | 239/526 X |
| 4,060,178 | 11/1977 | Miller | 417/473 X |
| 4,090,818 | 5/1978 | Hope et al. | 417/473 |
| 4,621,770 | 11/1986 | Sayen | 239/526 X |
| 4,828,180 | 5/1989 | Kristensen | 239/526 X |
| 4,832,580 | 5/1989 | Tsuyoshi et al. | 417/473 X |
| 4,850,536 | 7/1989 | Teranishi et al. | 239/526 X |

FOREIGN PATENT DOCUMENTS

| | | |
|---|---|---|
| 56-85079 | 12/1981 | Japan . |
| 58-11387 | 3/1983 | Japan . |
| 60-122583 | 8/1985 | Japan . |

*Primary Examiner*—John Rivell

*Attorney, Agent, or Firm*—Sughrue, Mion, Zinn, Macpeak & Seas

[57] ABSTRACT

A small and lightweight compressor has a motor which generates rotational drive which is converted into reciprocating movement to actuate an air compressing mechanism to thereby discharge compressed air. Three or more air compressing members are successively operated with a phase difference therebetween to thereby continuously discharge a smooth current of compressed air out of a discharge hole. The compressor can be part of a spray apparatus with an air brush in which a movable needle valve is inserted in a liquid path. The needle is moved by operation of a rod 70. Compressed air from the compressor is communicated with the air path to thereby spray the liquid. The air brush has a control surface which is the upper surface of a base portion of the rod, which is pivotable with respect to the body. A sliding member is axially movably disposed so that when the rod is actuated (manually usually), the amount of movement of the rod (i.e. its range of movement) can be adjusted by making the lower end of the sliding member abut against the control surface.

7 Claims, 7 Drawing Sheets

COMPRESSOR, SPRAY APPARATUS USING THE COMPRESSOR, AND AIR BRUSH FOR THE SPRAY APPARATUS

This is a continuation of application Ser. No. 327,051, filed Mar. 22, 1989, now abandoned.

BACKGROUND OF THE INVENTION

The present invention relates to a compressor, a spray apparatus using the compressor, and an air brush for the spray apparatus.

In particular, the present invention relates to a small, lightweight portable compressor. In the compressor, rotational drive, from a small battery powered DC motor is converted into reciprocating movement to actuate a compressing mechanism. The transmission of the reciprocating movement to the compressing mechanism causes the mechanism to continuously discharge compressed air out of a discharge hole. The invention also relates to a spray apparatus which employs the above portable compressor. The spray apparatus emits a homogeneous and fine particle spray liquid, which is effective for forming a coating over a relatively small area or a coating with a line pattern. The invention also relates to an air brush suitable for use in the spray apparatus.

Previous compressors have used rotational drive of a motor energized by an AC power source or high gas-pressure of a cylinder filled with a flon gas, an LP gas, or the like. These compressors have been used mainly as a supply source of compressed air for a spray gun, an air brush, or the like.

Compressors using an AC power source have primarily been used as large-sized stationary compressors. To obtain compressed air having a suitable discharge pressure, such compressors have required a subsidiary device such as a pressure adjusting regulator, a drain separator for exhaust drain generated owing to a high pressure, an expensive air filter for highly accurately maintaining the reciprocating movement of a piston or the like, and so on. Further, using an AC power source, the compressor has a limit in view of its use environment (e.g. place, conditions, etc.), and therefore has not been, useful as a portable light compressor.

In a high-pressure gas cylinder system, although portability is achieved, the quantity of effective use of gas per gas cylinder is small, and gas temperature is reduced due to the heat of vaporization in continuous spraying which thereby deteriorates the vaporization of the gas. This deteriorated vaporization reduces the discharge pressure making the system apt to be disabled.

Further, in a gas cylinder system, a suitable one of various kinds of gas cylinders differing in structure of their connection portions and a suitable kind of gas must be selected depending on the apparatus to be connected to the system. Therefore, an exclusive cylinder must be prepared, but there has been a problem in atmospheric pollution due to the flon gas and danger due to the combustible gas.

Japanese Utility Model Unexamined Publication Nos. 56-85079, 60-122583, for example, have proposed portable air pumps in which a motor and a driving portion are housed within a casing and battery actuated.

The respective air pumps disclosed in Publication Nos. 56-85079 and 60-122583 have mechanisms for discharging air through expanding/shrinking of a bellows and through vibrations of a diaphragm, respectively.

However, these air pumps cannot satisfy the necessary requirements for use with a spray gun and an air brush because each pump not only has a low discharge pressure and a low flow rate but also pulsating air.

Further, e.g. Japanese Utility Model Post-Exam Publication No. 58-11387 discloses a spray apparatus in which a motor and a driving element are housed within a casing, and in which a liquid to be sprayed is pressurized and atomized directly by means of a pump. This spray apparatus is, however, not suitable for forming a coating in which a homogeneous coated-film is required although the apparatus is suitable for spraying a medical liquid or the like, because the particle size of the atomized liquid is relatively large.

SUMMARY OF THE INVENTION

It is an object of the present invention to eliminate the foregoing disadvantages in the conventional compressor using an AC power source and in the high-pressure gas cylinder system.

It is also an object to achieve a compressor in which rotational drive is converted into reciprocating movement by means of a small battery powered DC motor energized so as to operate an air compressing mechanism to obtain compressed air.

It is a further object to provide a compressor which is small and light weight, which is simple, portable, and use for most applications, and which can continuously supply a smooth flow of compressed air having a suitable discharge pressure and a suitable flow rate to a small spray gun an air brush, or the like.

It is an additional object to provide a spray apparatus using the above compressor in which a homogeneous atomized liquid of fine particle size can be sprayed and which is effective for forming a coating over a relatively small area or in a line pattern.

It is yet another object to provide an air brush suitable for the above spray apparatus.

A compressor according to the present invention is small in size and light weight. In the compressor, a motor generates rotational drive which is converted into reciprocating movement in order to actuate an air compressing mechanism to thereby discharge compressed air. In particular, three or more air compressing members are successively operated with a phase difference therebetween in response to the rotational drive of the motor to thereby continuously discharge a smooth current of compressed air out of a discharge hole.

One aspect of the invention is a portable compressor for converting rotational drive of a motor into reciprocating movement to actuate an air compressing mechanism to discharge compressed air. The compressor has a casing which houses: a small DC motor with output power of 1 W to 80 W; reduction gears connected to an output shaft of the motor: conversion mechanisms for converting the rotary force of the reduction gears into reciprocating movement; actuators connected to said conversion mechanisms and reciprocatably mounted on guides formed within the casing: and three or more air compressing members attached to the actuators, respective end opening portions of the members being coupled in a closely-sealed state with a valve block: the valve block, which is provided with valve pairs equal in number to the number of members. Each of the valve pairs has a suction valve and an exhaust valve for controlling the suction and exhaust operation of a corresponding one of the compressing members, the valve block being further provided with an air collecting path for leading air discharged from the respective exhaust valves to a discharge hole, whereby the compressing members are successively actuated with a phase difference therebetween to continuously discharge compressed air through the discharge hole in response to the rotational drive of the motor. The reduction gears are arranged so that the reduction gear ratio thereof is selected to be 15:1 to 60:1 relative to the output of the motor, in which the cranks are provided on opposite ends of an output shaft of the reduction gears with a phase difference of 90 degrees therebetween. The actuators are connected to opposite ends of the cranks and attached so as to be reciprocatably guided by the guides, which are shaped rail-like. The suction valves and exhaust valves in four pairs are provided on the valve block so that two of the four pairs are opposite to the other two pairs, and the four compressing members are attached in a closely-selated state to the valve block so that the respective one end opening portions of the four compressing members communicate with the four valve pairs and the respective other ends of the four compressing members are connected to the actuators, respectively.

The invention further includes a spray apparatus in which an air brush is connected to the compressor, the air brush having an axial liquid path and an air path separated from the liquid path. Both of these paths are provided in a body. A needle valve is inserted in the liquid path to be movable forward or backward by means of the operation of a rod, and a liquid supply tank is made to communicate with the liquid path. Compressed air from the compressor is communicated with the air path to thereby spray the liquid out of a nozzle provided at the forward end of the body. The air brush has an axial slide groove formed in the upper surface of the body at a position opposing a control surface. This control surface is the upper surface of a base portion of the rod, which is pivotable with respect to the body. A sliding member is axially movably inserted in the slide groove so that when the rod is actuated (manually usually), the amount of movement of the rod (i.e. its range of movement) can be adjusted by making the lower end of the sliding member abut against the control surface.

BRIEF DESCRIPTION OF THE DRAWING

The above and other objects, features and advantages of the present invention will be evident upon reading the following detailed description in conjunction with the accompanying drawings, in which.

DETAILED DESCRIPTION OF THE PREFERRED EMBODIMENTS

Figure 2:
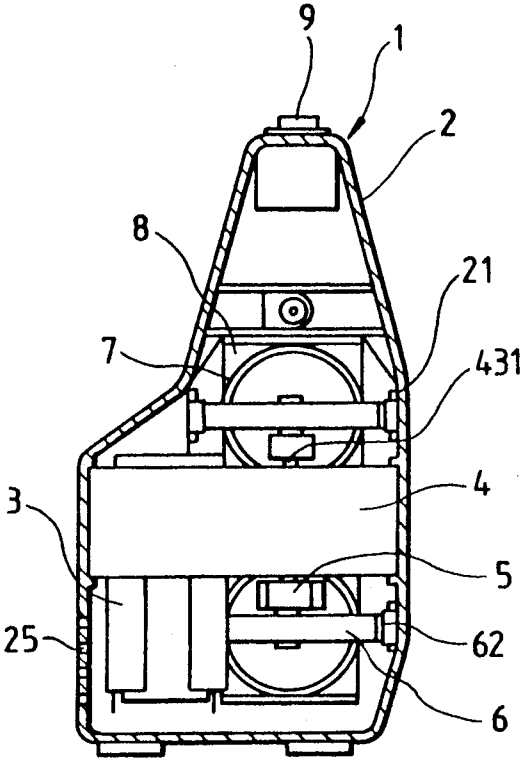
FIG. 2 is a sectional view taken along line A—A of FIG. 1.
Figure 1:
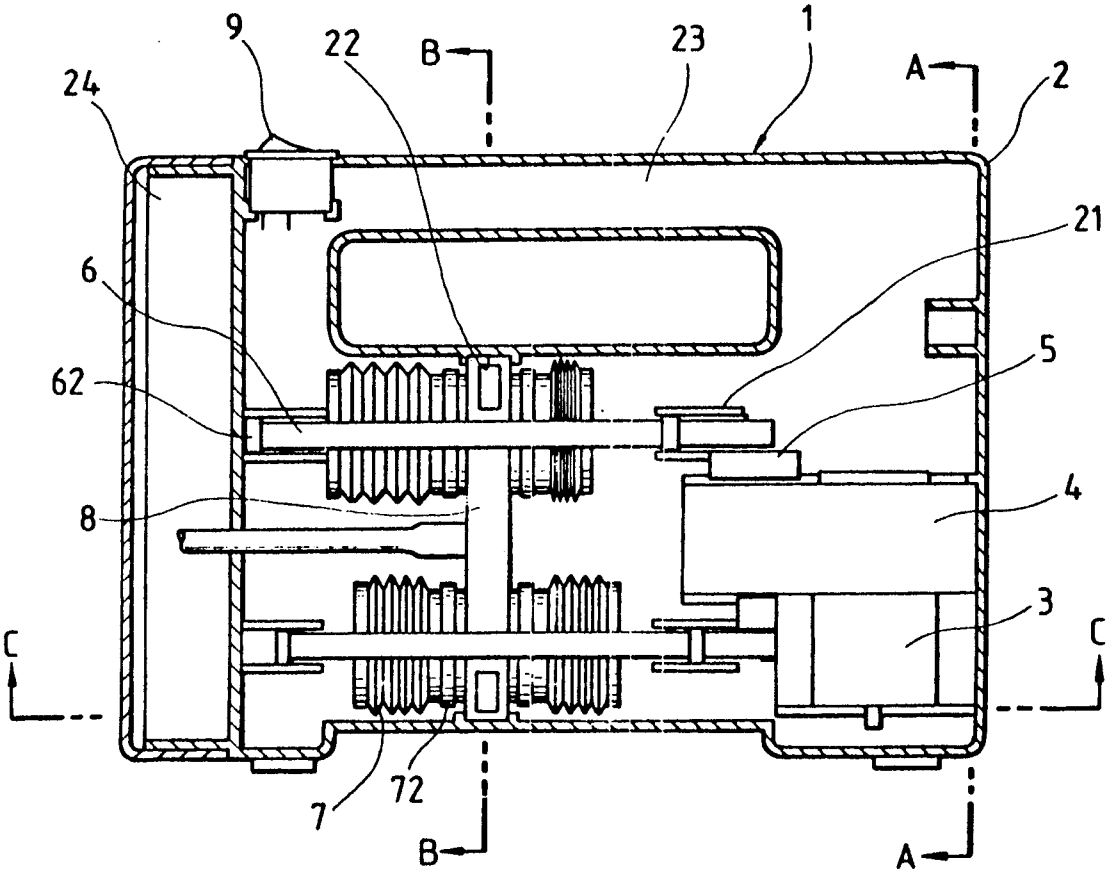
FIG. 1 is a front longitudinal sectional view showing a main part of the compressor according to the present invention.
Figure 4:
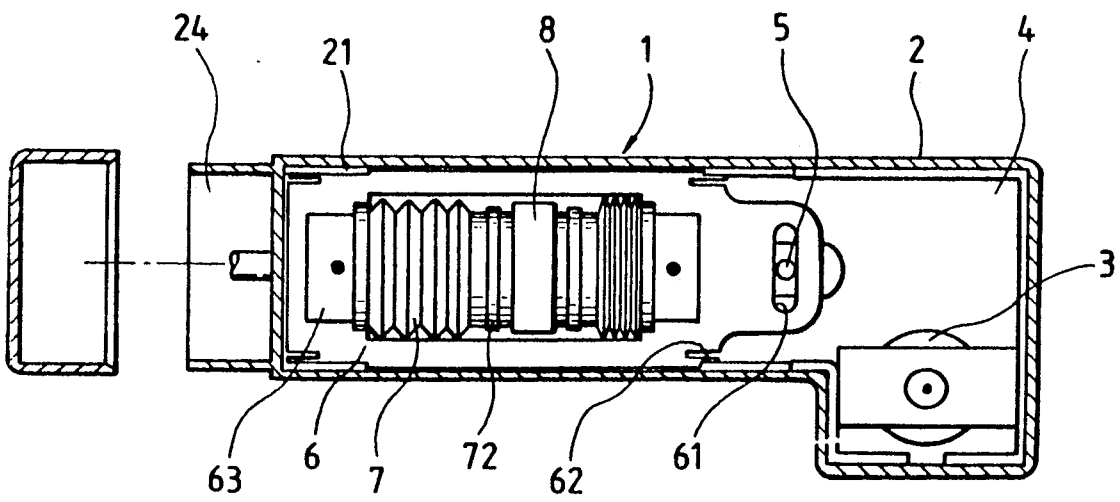
FIG. 4 is a sectional view taken along line C—C of FIG. 1 with the cover of the casing removed.
Figure 3:
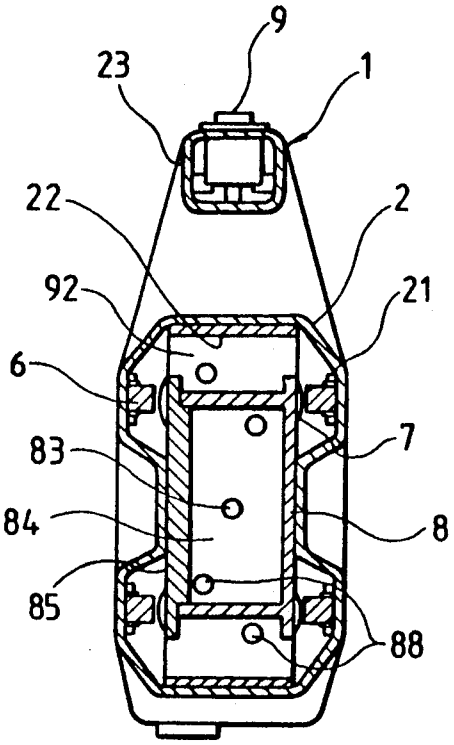
FIG. 3 is a sectional view taken along line B—B of FIG. 1.

The invention is a spray apparatus 10 (FIG. 8) which includes an inventive compressor 1 and an inventive air brush 20 connected by a pipe.

The compressor 1 will now be described with reference to FIGS. 1–7.

The compressor has a casing 2 with a small DC motor 3 having output power of 1 W to 80 W, reduction gears 4 connected to an output shaft of the motor, and conversion mechanisms 5 for converting the rotary force of the reduction gears into reciprocating movement. Actuators 6 are connected to the conversion mechanisms and reciprocatably attached to guides 21 formed within the casing 2. Three or more air compressing members 7 are attached to the actuators. Each member 7 has a first end opening portion which is coupled in a closely-sealed state with a valve block 8. The valve block 8 is provided with valve pairs equal in number to the air compressing members 7, each of the valve pairs having a suction valve 81 and an exhaust valve 82. These valve pairs 81, 82 control the suction and exhaust operation of a corresponding one of the air compressing members 7. The valve block 8 is further provided with an air collecting path or chamber 84 for leading air discharged from the respective exhaust valves 82 to a discharge hole 83.

The casing 2 is container shaped, box-like or any other suitable shape, and is made of a metal, a synthetic resin, or the like. The casing is provided for housing, mounting and protecting a series of driving elements, and for providing portability.

The reduction gears 4 may differ in the number of teeth from each other and are enmeshed with each other. The gears 4 may be large and small belt wheels rotated through a belt having teeth, or the like. The reduction gears 4 are arranged so that the reduction gear ratio thereof is 15:1 to 60:1 relative to the output of the motor 3. The conversion mechanisms 5, such as cranks, cams, or the like, for transforming motor torque into reciprocating movement, are connected to the output shaft of the reduction gears so that the mechanisms 5 are rotated at 150 to 1200 r.p.m. The mechanisms 5 arranged to successively axially reciprocate the respective actuators 6 with a phase difference therebetween.

The air compressing members 7 are constituted by axially expandable/shrinkable bellows, combinations of cylinders and pistons, or the like, so as to repeatedly compress air and discharge the compressed air out of the respective end opening portions thereof.

The members 7 are connected at their other ends, which are closed portion sides, to the actuators 6, respectively, and connected at their open portion sides in a closely-sealed state to the valve block 8. The block 8 is fixed in the casing 2. The actuators 6 are guided by the guides 21 for reciprocation. This reciprocation actuates the suction valves 81 and the exhaust valves 82 of the block 8 by pressuring and releasing pressure from the close portion sides of the members 7 so that compressed air is discharged from the exhaust valves 82 and led to the path 84.

The path 84 is communicated with the exhaust valves 82 of the respective compressing members 7 so as to gather the compressed air discharged from the respective exhaust valves 82 and lead the gathered air to the discharge hole 83.

The guides 21 may be formed by: rail-like guides integrally formed in the inner walls of the casing 2; guide holes formed in projecting pieces from the inner walls of the casing 2; separately provided members constituted by guide grooves, guide holes, etc., and fixed to the casing, etc; or the like.

A conventional battery such as a manganese-alkali battery, a nickel cadmium battery, a lead battery, or the like, may be used to power the motor 3.

The battery is removably mounted inside or outside the casing.

A power-source switch 9 may be attached to the casing 2 at its upper portion or at its side portion in the exposed state, or it may be a remote control switch, such as a foot actuable switch for convenience.

In order to use the compressor for a long time, an AC adapter may be connected to the compressor.

In the preferred embodiment, the compressor is a system using four air compressing members 7, which are successively operated with a phase difference therebetween so that compressed air having desired discharge pressure and flow-rate is continuously discharged with minimal pulsation. In the compressor, the driving elements are compactly and efficiently arranged in the casing 2 so that the compressor is small, lightweight and portable.

In the compressor, the cranks 5 are provided on the opposite ends of the output shaft of reduction gears 4 with a phase difference of 90 degrees therebetween. The actuators 6, connected to the opposite ends of the cranks, are guided by the rail-like guides 21 of reciprocal motion. The four pairs of suction valves 81 and exhaust valves 82 are provided on the valve block 8 so that two pairs are opposite to the other two pairs.

To operate the compressor 1, the switch 9 is turned on to rotate the motor 3. Rotation of the motor 3 is reduced by the gears 4 connected to the output shaft of the motor 3 to drive the conversion mechanisms 5 (cranks or cams) with increased torque, so that the torque is converted into reciprocating movement which is in turn transmitted to the respective actuators 6. The mechanisms 5 are successively driven with a phase difference relative to an output shaft 431 of the reduction gears 4, so that the compressing members 7 are reciprocatable to alternately communicate with the four pairs of suction valves 81 and exhaust valves 82. Thus, the air compressed by the respective exhaust valves 82 with a phase difference, gathered into an air collecting path 84, and continuously discharged through the hole 83. An air hose pipe, or the like is connected to the hole 83 so as to supply the compressed air to equipment using the air.

Figure 8:
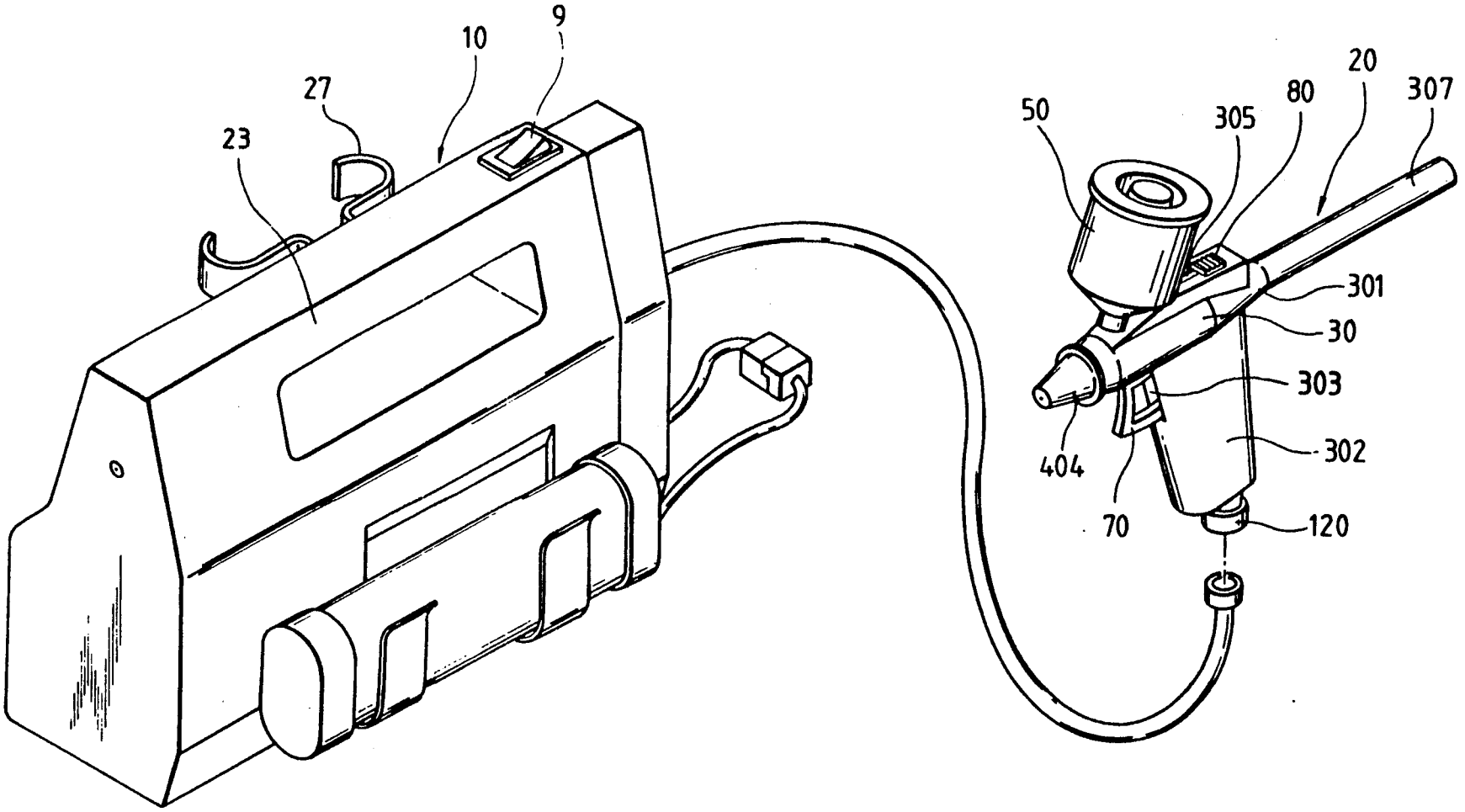
FIG. 8 is a perspective view of the spray apparatus according to the present invention.
Figure 9:
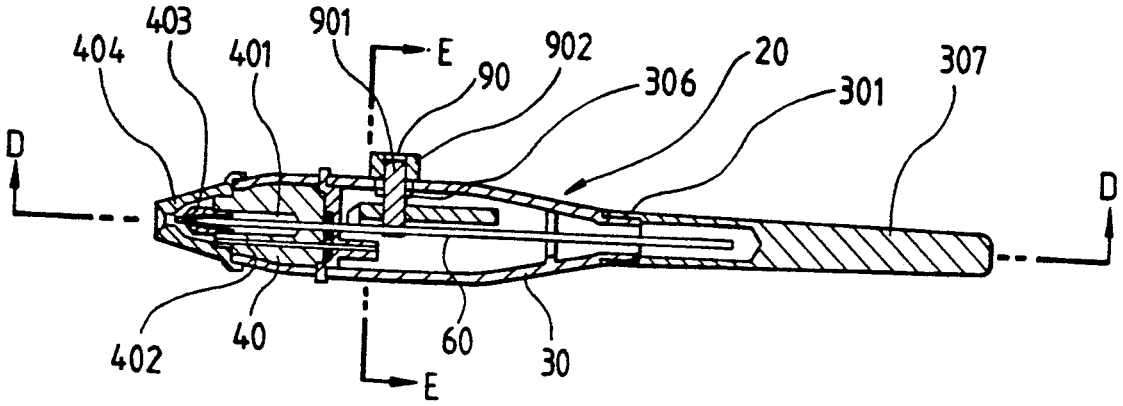
FIG. 9 is a longitudinal sectional view of the air brush according to the present invention.
Figure 10:
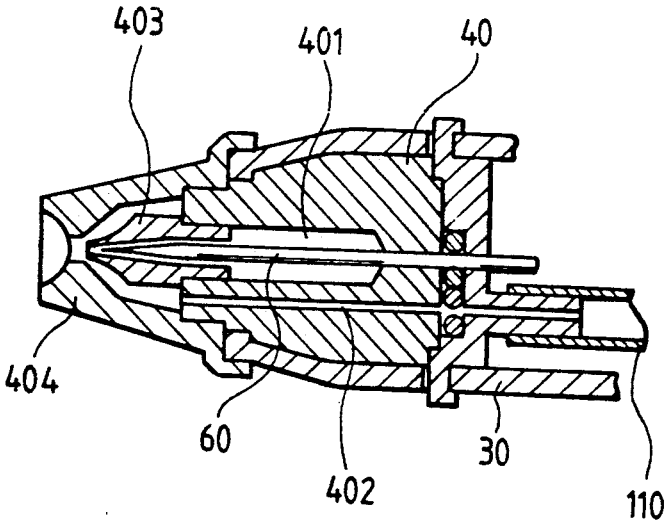
FIG. 10 is an enlarged sectional view of the forward end portion of the air brush of FIG. 9.
Figure 11:
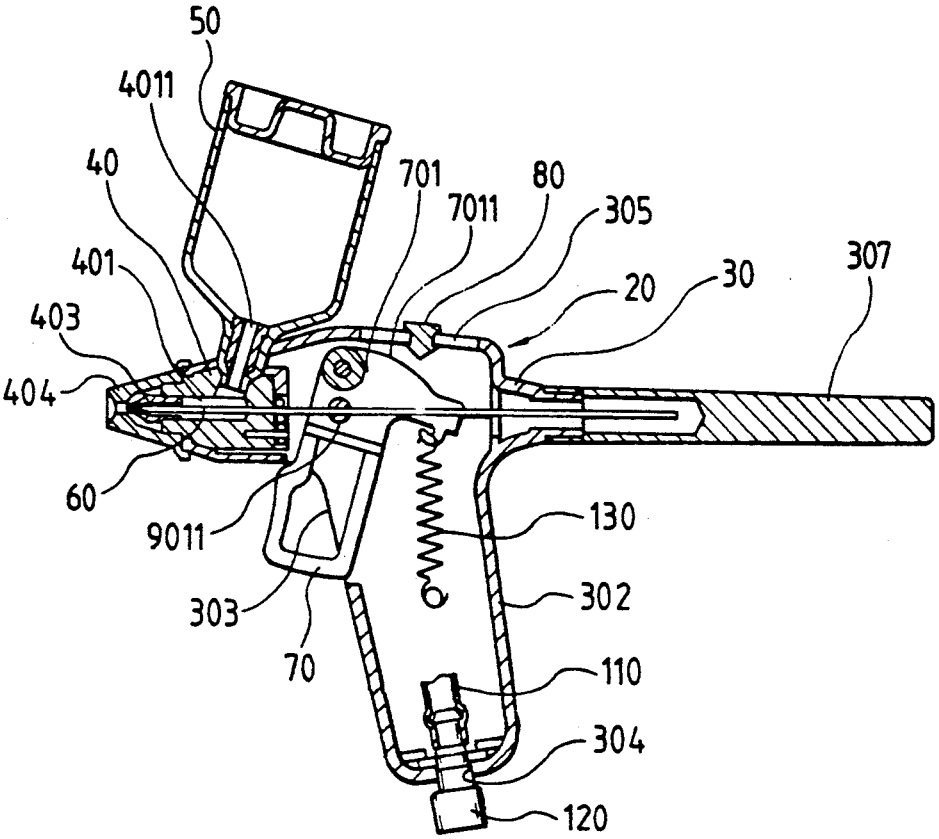
FIG. 11 is a sectional view taken along line D—D of FIG. 9.
Figure 12:
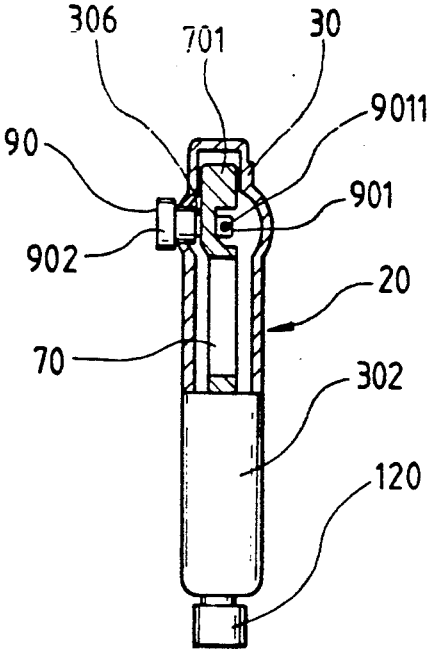
FIG. 12 is a sectional view taken along line E—E of FIG. 9.

In the spray apparatus 10, the discharge hole 83 of the compressor 1 is connected to an air path 402 of the air brush 20 by a pipe through a coupler 120 (FIG. 8). The air brush 20 is of a type from which liquid is sprayed due to the suction force of compressed air.

An embodiment of the air brush 20 which is preferable for use in the spray gun 10 will now be described in detail with reference to FIGS. 9 through 12.

The inventive portable spray apparatus 10 uses the air brush to spray a homogeneous atomized liquid of fine particle size, and is effective to coat a relatively small area or coat in the pattern of a line or the like.

The air brush has a body casing 30 is a pistol-type hollow body composed of two plastic molding members combined with each other. The casing has a cylindrical opening formed at a front portion, a reduced diameter cylindrical portion 301 provided at its rear portion and a large handle portion 302. The front of the casing 30 has a hole 303 into which a trigger of an operating rod 70 is mounted for forward and backward movement. The handle portion 302 has a mounting hole 304 formed at its lower end for attaching the coupler 120. A hole for mounting a liquid supply tank 50 is formed at an upper front portion of the body 30. An upper central portion of the body 30 has an axial slide groove 305 for slidably mounting a member 80. A window hole 306 for receiving a nut 902 of a fastening device 90 of a needle 60 is formed in one side surface of the body 30.

A head member 40 of brass is removably mounted in the cylindrical opening at the front of the casing 30. The head 40 has therein axial liquid path 401, and a liquid path 4011 branches from the liquid path 401 to communicate with the liquid supply tank 50. The head also has an axial air path 402 separated from the liquid paths 401, 4011. A nozzle 403 having a central hole is engaged with the head 40 at its front end so that the central hole is communicated with the liquid path 401. More specifically, a nozzle cover 404 has a spray orifice formed at its forward end covers the nozzle 403 and is engaged with the cylindrical opening of the casing 30.

The liquid tank 50, which communicates with the liquid path 4011, is best made of transparent plastic to enable observation of the liquid quantity remaining.

The needle 60 is mounted for forward or backward movement, and is inserted in the liquid path 401, thus forming a needle valve. A pipe 110 made of soft polyvinyl chloride is connected proximate one end of the air path 402, the other end of the air path 402 being connected to the coupler 120.

The needle 60 is connected to a base portion 701 of the rod 70 through the fastening device 90 for forward and rearward movement in response to movement of the rod. The device 90 has a hole 9011 formed in the top of a bolt member 901, the needle 60 being inserted in the hole 9011 and fixedly fastened using a nut 901. Therefore, the needle 60 can be unfastened by rotation of the nut 902 so as to make the fixed position of the needle 60 adjustable. A non-return packing is inserted in the intermediate portion between the liquid path 401 and the air path 402.

A base portion 701 of the rod 70, which operates the valve 60, is pivotably mounted with respect to the casing 30, and a rear portion of the rod 70 is connected to a spring body 130, so that the trigger of the rod 70 can be automatically returned after pulling of the trigger has been completed. A smooth curved control surface 7011 is formed on the upper surface of the base portion 701. The control surface is arranged to adjust or limit the backward stroke of the needle 60 together with the sliding (control) member 80.

The sliding member 80 is axially movably inserted in an axial slide groove 305 formed in the upper surface of the body 30 at a position opposing the surface 7011. The slide groove 305 and the sliding member 80 are ratchet-engaged with each other. When the control surface 7011 and the lower end of the sliding member 80 abut each other while the trigger portion of the rod 70 is being pulled, the pulled quantity (amount that the rod 70 is pulled with respect to the casing 30) can be finely adjusted. In addition, the quantity of spray can not only be finely adjusted, e.g. by a friction fit, but also maintained constant due to the abutment of the member 80 and control surface 7011, and by engaging the member 80 in the groove 305 using a ratchet engagement.

A metal rod body 307 is helically threaded around the rear cylindrical portion 301 of the body 30 so as to balance the weight with the head member 40 provided in the front portion of the body 30. That is, the cylindrical portion 301 may be threaded so the body 307 can be threadedly engaged with the portion 301.

The air brush is arranged such that the head 40 can be easily removed if the nozzle cover 404 and the rod body 307 are removed and the body 30 is divided into the two members.

The operation of the spray apparatus 10 according to the present invention will be described next.

The forward end of the pipe connected to the discharge hole 83 of the compressor 1 is connected to the air path 402 (FIGS. 8 and 9) through a coupler 120 (FIG. 11) of the air brush 20, and then the compressor 1 is driven with liquid tank 50 (FIG. 11) filled with the liquid to be sprayed. The compressed air discharged from the pipe connected to the compressor 1 is led to the air path 402 through a vinyl pipe 110 in the air brush 20 so as to be sprayed from the forward end of a nozzle cover 404, so that the liquid in the liquid path is sprayed out of the forward end of the nozzle 403 by the sucking action at this time (because an orifice is formed int he nozzle cover 404 at its forward end so that atomization is enhanced). At this time, the valve 60 in the liquid path 401 is moved using the rod 70 to adjust the opening area of the path. That is, the pulled quantity of the rod 70 controls the quantity of spray, and the rod 70 can be released to advance the needle 60 to close the path and thereby stop the spray.

According to the present invention, the air brush 20 is arranged such that the sliding member 80 abuts the control surface 7011, so as to make the pulled quantity of the rod, and thus the backward stroke of the needle 60, adjustable. Accordingly, in operation, it is possible to move the sliding member 80 to adjust the pulled quantity and then stop the sliding member 80 at a predetermined position so as to finely adjust the quantity of discharge to a target value, so as to keep the quantity of discharge fixed, or so as to properly change the same.

Further details of the compressor according to the present invention will be described referring again to FIGS. 1 through 7.

The casing 2 is a box-like container (about 20 cm in width, 15 cm in height, and 8 cm in depth (at the largest portion)) composed of two injection moldings of thermoplastic resin combined with each other so as to form a space therebetween for housing driving elements therein. A portable holder 23 and a housing portion 24 for housing a hose, an exchanging nozzle, tools, etc. are provided in the casing 2 at its upper portion and at a side end portion respectively. Eight rail-like guides 21 for guiding two actuators 6 are provided on the inner walls of the casing at positions horizontally and vertically opposite to each other with predetermined intervals, that is, four being opposite to the other four in the horizontal direction, four being opposite to the other four in the vertical direction. An engaging groove 22 for fixing the valve block 8 is provided in the inner wall of the casing at its intermediate portion. A ventilating hole 25 for preventing the motor 3 from heating is provided in the casing 2 at the upper portion of the motor housing portion.

Figure 5:
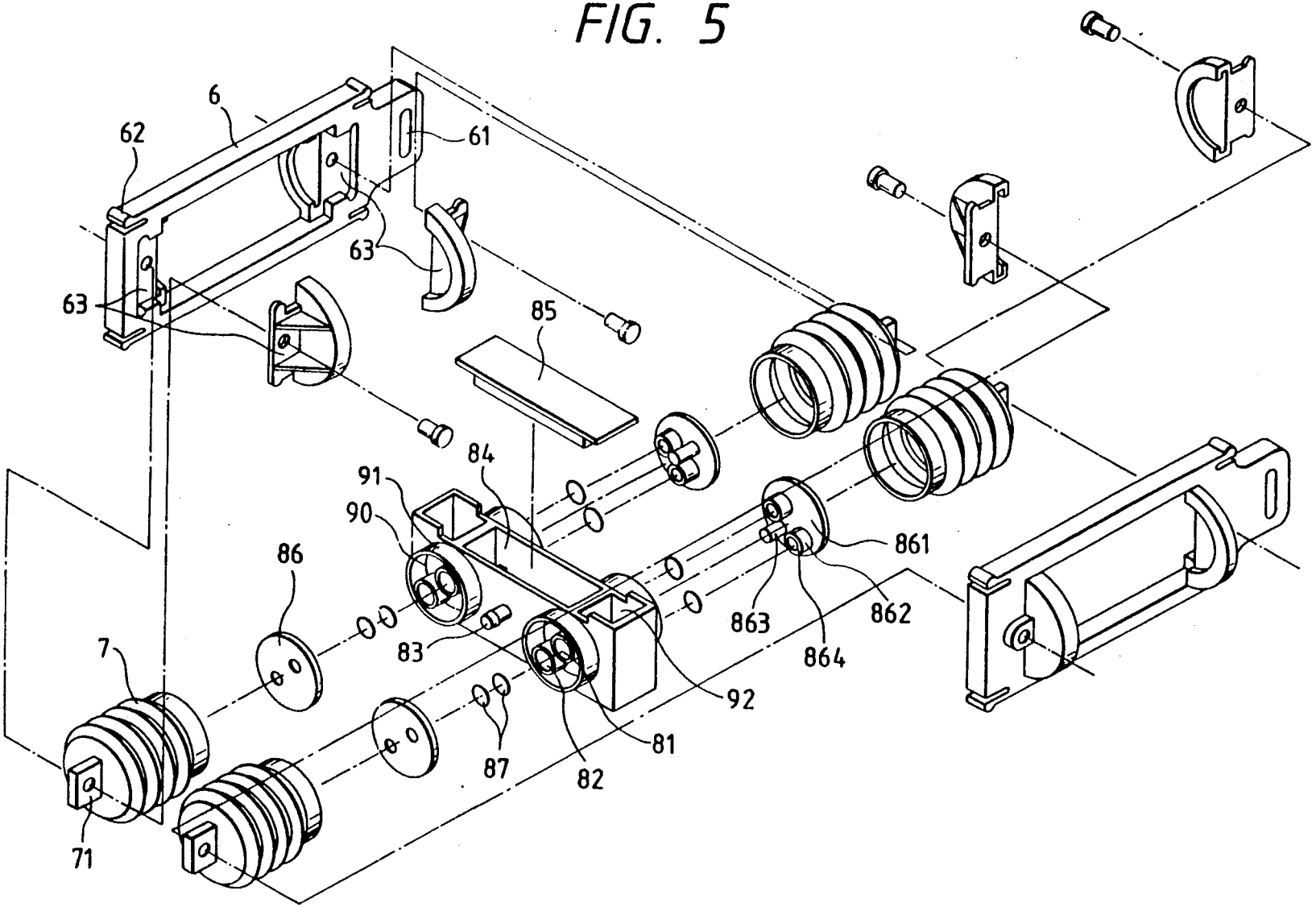
FIG. 5 is an exploded perspective view showing main constituent elements of the compressor.
Figure 6:
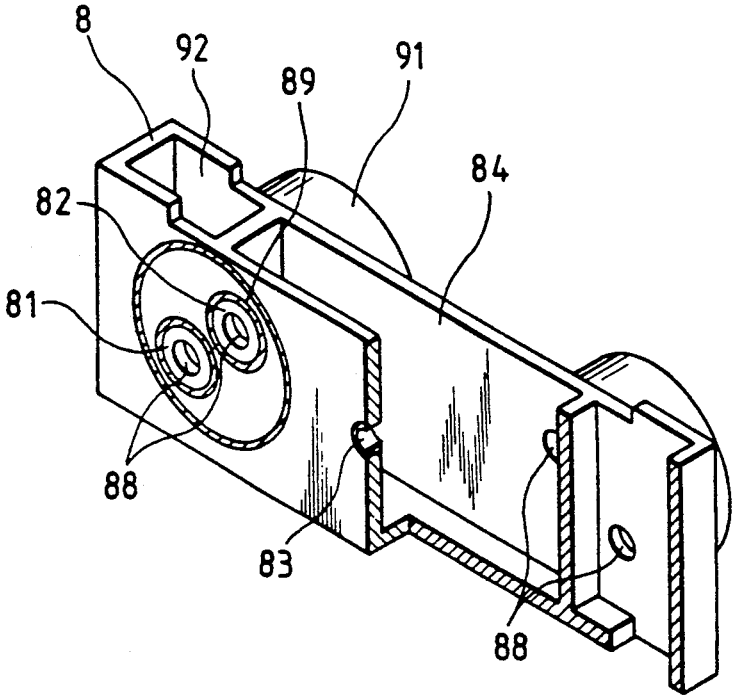
FIG. 6 is a partially cut perspective view of the valve block of the compressor.
Figure 7:
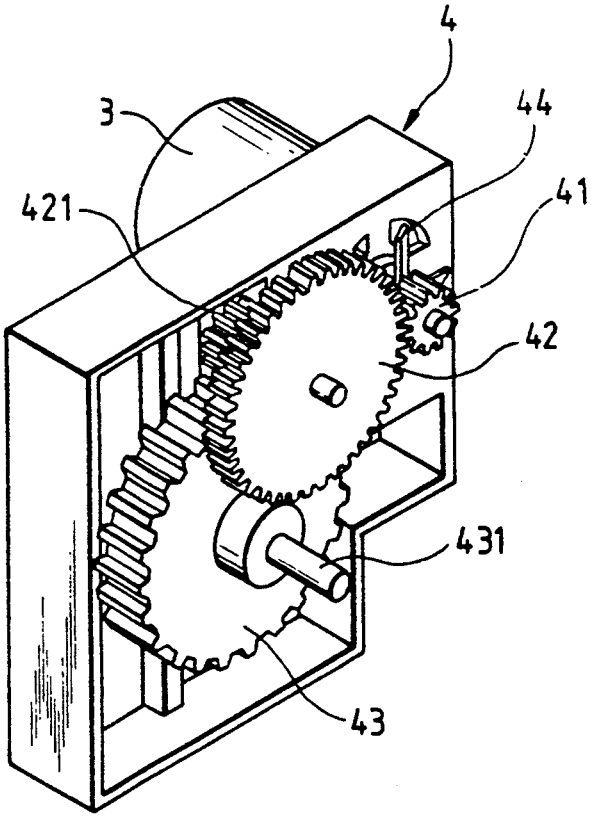
FIG. 7 is a partially cut perspective view of the reduction gears of the compressor.

The block 8 is constituted by a rectangular box-like body portion formed by plastic injection molding, a cover portion 85 for closing the opening portion of the body portion, cover members 86 forming outer shells of valve portions, and valve bodies 87 (see FIGS. 5 and 6).

Eight valve holes 88 are formed in the opposite walls of the body portion. Specifically, four pairs each having a suction valve hole and an exhaust valve hole, two of the pairs opposing the other two pairs. Four small projections 89 are equidistantly formed on the circumferential wall surface of each of the exhaust valves 82. A cylindrical portion 90, having a larger diameter than that of the valve hole, projects from the valve block 8 and is concentrically provided around each of the valve holes 88. An annular projecting portion 91 encircles each pair of the cylindrical portions 90. Each of the exhaust valve holes is communicated with the path 84 formed between opposite side walls, and a discharging hole 83 is formed integrally with the path 84 at the center portion of the latter. Each of cover members 86 is integrally provided with a plate portion 861 for covering the opening plane of each of the annular projecting portion, and a positioning pin 863. The outer diameter of the fitting cylinder is selected to be a little smaller than the inner diameter of the cylindrical portion 90. Four small projections 864 are equidistantly formed on the front end surface of one of the fitting cylinders 862.

The valve bodies 87 are formed of thin plates made of polyester resin. In this embodiment, there are eight valve bodies.

The valve bodies 87 are disposed on the valve holes, respectively. The cover members 86 are fitted with the fitting cylinders 862 having the small projections 864 positioned in the suction valve side with the aid of the positioning pins 863, and the cover portion 85 is fitted to the opening portion of the body portion, thereby completing assembly of the valve block 8.

An air filter such as a sponge or the like is provided in the end of the opening of a suction chamber 92 of the valve block 8 on the suction valve side so that foreign matter can be prevented from entering the chamber 92. Each of the actuators 6 is a frame member having a cam groove 61 formed at one end portion, a slot formed at its center portion, slide support portions 62 formed on the respective end portions on the outside of the frame, and fixing portions 63 formed at opposite portions on the axial line of the slot portion for fixing the one end closed portions of bellows members (air compressing members). Two actuators are prepared using plastic injection molding.

Each of the bellows members 7 is formed as a hollow body having an expandable/shrinkable bellows portion (an outer diameter of 33 mmϕ, a length of 38 mm) prepared through blow molding of polypropylene resin, the bellows portions having one end closed and provided with an attaching portion 71, and the other end opened. There are four bellows members 7.

The members 7 are attached to the actuators 6 respectively in a manner so that the attaching portions 71 are connected to the fixing portions 63 of the actuators 6, respectively. The respective opening portions of the bellows members 7 are disposed to be opposite to the free ends of the actuators 6. The annular portions 91 of the block 8 are fitted to the opening portions of the members 7, respectively, and the fitted portions are fastened with fastening bands 72, respectively. Thus, the actuators 6 are bridge-like connected with each other through the valve block 8.

Reduction gears 4 (FIG. 7) are arranged so that the driving power of the small DC motor 3 is transmitted to a gear 43 (having sixty five teeth) through a pinion gear 41 (having ten teeth) fixed to the output shaft of the DC motor 3, a gear 42 (having sixty teeth engaged with the pinion gear 41), a gear 421 (having fifteen teeth engaged with the gear 43) provided on the shaft of the gear 42. The gear 43 has an output shaft 431 provided so as to project outwards from the opposite sides of the gear 43, and the cranks 5 are provided on the opposite ends of the output shaft 431 of the gear 43 with a phase difference of 90 degrees therebetween. Thus, the reduction gear ratio of the reduction gears is 26:1, and the speed of rotation of the crank 5 is about 600 r.p.m. A fan 44 for air-cooling the motor 3 while the motor rotates is mounted on the pinion gear 41. The cranks 5 are slidably inserted into cam grooves 61 of the actuators 6 respectively to thereby constitute a pump mechanism.

The valve block 8 is engaged with the groove 22 in the casing, and the support portions 62 of the two actuators 6 are slidably inserted in the guides 21, respectively, thus the pump mechanism is arranged. The motor 3 is connected to a jack for a power source (a battery or an AC adapter) through a switch 9.

A battery holder 26 was attached to the casing at its outside, and a 7.2 V nickel-cadmium battery pack (1.2 A/H) was removably mounted, thereby completing the assembly of the compressor 1.

The compressor 1 was continuously driven. As a result of the examination of the discharging performance, the maximum air pressure was 1.2 kg/cm$^2$ and the quantity of wind was 20 l/min. It was thus confirmed that the compressed air was smoothly continuously discharged.

In the system to which the air brush is applied, an air brush support 27 may be attached to the casing 2 at its outer surface for convenience.

Using the rotation drive of a motor 3 actuated by a battery and having a structure in which driving elements are compactly housed in a casing, the compressor 1 according to the present invention is small and light enough to be portable. Not only is there no limit in use location, use conditions, etc. of the system using the AC power source, but there are also no disadvantages such as atmospheric pollution, flash trouble, insufficiency to maintain discharge pressure especially over long term use, or the like, which are found in the high-pressure gas cylinder system. The compressor is safe, and further can maintain its original performance level by recharging or replacing the battery.

Further, three or more air compressing members 7 are successively operated with a phase difference therebetween in response to the rotational drive of the motor 3. The operation of the compressing members gathers the compressed air, minimizing pulsations and achieving suitable discharge pressure and flow rate. The air can be continuously discharged from the discharge hole 83, and the compressor can be easily adapted for various uses requiring compressed air, such as for a portable spray gun, a toy, etc.

According to the present invention, the spray apparatus 10 has a suction type air brush 20 for creating a mist-like spray of liquid connected to the compressor 1, so that the coating liquid having fine particle size and homogeneous quality can be continuously discharged without appreciable pulsations, variations in strength, etc. Thus, it is possible to provide a portable spray apparatus which is convenient for coating a relatively small area or for coating in a thin-line pattern.

Advantages of the air brush according to the present invention include simplicity of operation, as the degree of pulling on the operation rod 70 can be finely adjusted, and further the discharged quantity of liquid can be fixedly maintained through the adjustment of the sliding members, so that the device is practical.

Further, the main parts can be easily disassembled and easily cleaned.

What is claimed is:

1. In a spray apparatus having a compressor for generating and discharging compressed air, and an air brush for receiving the compressed air and creating suction using the compressed air to spray the liquid out of a nozzle, an means for supplying the discharged compressed air to the air brush, said compressor comprising:

a casing;

a small DC motor having an output power of between 1 W and 80 W, said DC motor being mounted in said casing and having an output shaft;

reduction gears mounted in said casing and connected to said output shaft of said motor;

conversion means mounted in said casing for converting the rotary force from said reduction gears into reciprocatable motion;

guide portions provided in said casing;

actuator members mounted in said casing, said actuator members being connected to said conversion means and reciprocatably disposed in said guide portions;

a valve block mounted in said casing;

at least three air compressing members mounted in said casing, one end of each of said compressing members being attached to one of said actuator members and the other open end being coupled with said valve block in a closely-sealed state;

pairs of a suction valve and an exhaust valve disposed in said valve block for controlling suction and exhaust operation of said air compressing members, a number of said pairs being equal to that of said air compressing members;

a discharging hole disposed in said valve block; and an air collection path disposed in said valve block for communicating compressed air exhausted from each of said exhaust valves with said discharging hole;

wherein said air compressing members are successively actuated with a phase difference therebetween to continuously discharge said compressed air out of said discharge hole in response to the rotational drive of said motor.

2. The spray apparatus according t claim 1, wherein said air brush further comprises:

an air path for receiving the compressed air supplied to said air brush and carrying the compressed air to said nozzle to create the suction;

valve means including a needle member movably mounted in a liquid path for regulating the amount of liquid spray through said nozzle;

operating means connected to said needle member and movable for moving said needle to regulate the amount of liquid spray, said operating means having a control surface formed thereon;

a control member mounted in said air brush for movement to various positions for engaging said control surface of said operating means to control the amount of motion of said operating means and thereby regulate the amount of liquid spray.

3. The compressor according to claim 1, wherein said compressing members are four in number.

4. The compressor according to claim 3, wherein said means for reciprocating reciprocates said four compressing members successively at 90° out of phase.

5. The compressor according to claim 1, wherein said compressing members comprise bellows.

6. The compressor according to claim 1, wherein said reciprocating means includes a battery.

7. A portable compressor, comprising:

a casing;

a small DC motor having an output power of between 1 W-80 W, said DC motor being mounted in said casing and having an output shaft;

reduction gears mounted in said casing and connected to said output shaft of said motor, a reduction gear ratio of said reduction gears being selected to be 15:1 to 60:1 relative to said output power of said DC motor;

cranks mounted in said casing for converting the rotary force from said reduction gears into reciprocatable motion, said cranks rotating at 150 to 1,200 r.p.m.;

guide portions provided in said casing;

actuator members mounted in said casing, said actuator members being connected to said cranks and reciprocatably disposed in said guide portions;

a valve block mounted in said casing;

three or more bellows members mounted in said casing, one end of each of bellows members being attached to one of said actuator members and the other open end being coupled with said valve block in a closely-sealed state;

pairs of a suction valve and an exhaust valve disposed in said valve block for controlling suction and exhaust operation of said bellows members, the number of said pairs being equal to that of said bellows members;

a discharging hole disposed in said valve block; and an air collection path disposed in said valve block for communicating compressed air exhausted from each of said exhaust valves with said discharging hole;

wherein said bellows members are successively actuated with a phase difference therebetween to continuously discharge said compressed air out of said discharging hole in response to the rotational drive of said motor.

* * * * *